US007131381B1

(12) United States Patent
Nafziger

(10) Patent No.: US 7,131,381 B1
(45) Date of Patent: Nov. 7, 2006

(54) SHOTGUN CLEANING SHELL DEVICE

(76) Inventor: Michael Nafziger, 8331 E. Monterey Way, Scottsdale, AZ (US) 85251

( * ) Notice: Subject to any disclaimer, the term of this patent is extended or adjusted under 35 U.S.C. 154(b) by 0 days.

(21) Appl. No.: 11/281,971

(22) Filed: Nov. 16, 2005

(51) Int. Cl.
*F42B 8/00* (2006.01)

(52) U.S. Cl. ..... 102/444; 102/442; 102/529

(58) Field of Classification Search ..... 102/529, 102/442, 444; 42/95
See application file for complete search history.

(56) References Cited

U.S. PATENT DOCUMENTS 938,836 A * 11/1909 Fessenden ..... 102/442
2,765,740 A 10/1956 Norman
3,147,708 A * 9/1964 Ferguson ..... 102/442
3,209,690 A * 10/1965 Mercatoris, Jr. ..... 102/442
3,476,047 A 11/1969 Davis
5,777,258 A 7/1998 Soon
2004/0244627 A1 12/2004 Bice et al.
2005/0252405 A1* 11/2005 Deskins ..... 102/529

* cited by examiner

*Primary Examiner*—Michael J. Carone
*Assistant Examiner*—Gabriel J. Klein
(74) *Attorney, Agent, or Firm*—Schmeiser, Olsen & Watts LLP

(57) ABSTRACT

A Shotgun Cleaning Shell for cleaning the bore of a shotgun, wherein the shell comprises: a cylindrical shell case, a head connected to an end of the case, a seal connected to the other end of the case, a bead contained within the case, a cord wherein an end of the cord is connected to the bead, at least one cleaning member connected to the cord, a squeegee connected to the other end of the cord, a tubular member connected to the squeegee and wherein the bead is contiguous the other end of the tubular member, a propellant device attached to the head and within the tubular member, wherein, the propellant device propels the bead through a bore of a shotgun, the bead exiting the bore, and wherein a user can propel the at least one cleaning member and the squeegee along the bore of the shotgun.

15 Claims, 2 Drawing Sheets

SHOTGUN CLEANING SHELL DEVICE

BACKGROUND OF THE INVENTION

1. Technical Field

This invention relates to a disposable cleaning device for use in shotguns which fits inside a standard shotgun shell casing that mimics traditional cleaning methods and allows the user to simply fire the gun and slowly pull on a cord in order to clean a shotgun bore.

2. Background Art

The use of shotguns is very popular in the United States and abroad. Shotguns, however, like all other guns require regular cleaning in order to keep the gun in the best condition possible. In fact, a shotgun must be cleaned after each use. One of the main areas of shotgun which requires regular cleaning is the bore.

Because of the inconvenience and time required to clean a shotgun, most shotgun owners (as much as 80%) do not clean their shotguns at all.

Currently, there are several basic types of bore cleaning systems known in the art. The first is the most commonly known and most traditional method of using a cleaning "kit". These kits consist of a long rod that can be assembled for running cotton wads laced with solvents or oils down the barrel. The user typically assembles a three part rod which, as an assembly, has one end that that looks like a large version of the "eye of a needle". The user "threads" a thin cotton pad thru the eye and dips it in a bottle of gun bore solvents which when applied repeatedly to the gun bore via the assembled rod acts as a to dissolve much of the residue left in a shotgun bore from use. These solvents are almost always distillates of petroleum based chemicals.

Next, the eye is unscrewed and a metal wire brush is attached to the assembled rod. The user then passes the brush through the bore several times depending on the severity of the glazing or residue build up.

The user then usually does another solvent swipe followed by a dry wad cleaning. After that the user then reattaches the eye and pours gun oil on a threaded cotton pad and coats the bore with gun oil.

The second method is described in U.S. Pat. No. 3,740,883 issued to Kyle. This patent describes a barrel or bore cleaning device which is simply a shotgun shell containing low density randomly woven resilient organic material which is propelled along the bore when primer in the shell is detonated. The organic material scrapes the bore of the shotgun while it passes through the bore removing the residue in the bore.

A third method is described in U.S. Pat. No. 2,765,740 issued to J. W. Norman. This patent discloses a bore cleaning shell that uses a cleaning wad comprising two spaced apart parallel discs filled with spongy or compressible material between them. A weight assembly comprised of two spaced apart parallel discs which are filled with rigid material between them. The weight assembly is connected to coiled wire springs. When the gun is fired, the weight assembly is moved out of the barrel. The springs then stretch, pulling the cleaning wad through the barrel. Once, fired, the cleaning is essentially complete.

A fourth device is described in U.S. Pat. No. 3,476,047 issued to D. M. Davis which describes a shell for cleaning a shotgun. In the Davis shell, a piercing needle is used to puncture the thin wall of a seal, allowing compressed gas contained in a chamber to escape the shell and force the contents of the shell through the shotgun barrel. A coarse scrubbing wad then cleans the debris from the barrel. A knife edge crimp slices plastic containers containing cleaning solvent and antirust when the shell is exploded allowing the solvent and antirust to leave the shell.

These various methods, however, tend to force the cleaning materials and solutions through the bore so quickly that the solutions do not have time to act on the residue in the bore. Additionally, many of the previous methods use "gun powder" to propel the cleaning devices, thereby causing the bore to be contaminated with gun powder residue defeating the purpose of the cleaning method. The methods also may potentially cause injury as cleaning materials are shot out of the bore at a high rate of speed. Accordingly, what is needed are improvements in a shotgun cleaning shell which thoroughly clean the bore of a shotgun while eliminating a majority of the potential that injury could be caused.

DISCLOSURE OF THE INVENTION

The present invention may be readily adapted to a variety of shotgun bore sizes. Embodiments of the present invention may provide, among other benefits: a safe, quick, easy, disposable and effective way to clean a shotgun bore. It also prevents long term exposure to petroleum distillates (gun bore cleaning solvents) and for those that are sensitive or hyper-sensitized to solvents a method for using gun bore solvents quickly with minimum exposure. This device will save the user significant time in cleaning and maintaining their shotgun without having to sacrifice the effectiveness of cleaning the shotgun bore by hand. Also, because this device uses a very low energy propellant it is much safer than many of the other shotgun shell cleaning devices on the market. Many collectors of shotguns have large inventories that must be maintained and in high humidity climates (most of the United States) these collections need to receive frequent gun oil treatments. This device facilitates a swift method of easily treating these collections and inventories with moisture barrier gun oil.

In particular embodiments, a shotgun shell cleaning device configured according to an embodiment of the present invention may comprise a cylindrical shell case, a head connected to an end of the case, a seal connected to an end of the case opposite the head, a bead contained within the case, a cord wherein an end of the cord is connected to the bead, a solvent cleaning wad connected to the cord adjacent to the bead, a bore scrubber pad connected to the cord adjacent the solvent cleaning wad, a dry wad connected to the cord adjacent the bore scrubber pad, a gun oil wad connected to the cord adjacent the dry wad, a collector wad connected to the cord adjacent the gun oil wad, a squeegee connected to the cord adjacent the collector wad and at an opposite end of the cord from the bead, a tubular member, wherein the squeegee is connected to an end of the tubular member, wherein the cord is outside the tubular member and the bead is contiguous an end of the tubular member opposite the end connected to the squeegee, wherein the solvent cleaning wad, bore scrubber pad, dry wad, gun oil wad, and collector wad encircle the tubular member, a propellant device connected to the head and within the tubular member, wherein the propellant device propels the bead through a bore of a shotgun; and wherein a user uses the cord to propel the solvent cleaning wad, bore scrubber pad, dry wad, gun oil wad, collector wad, squeegee and tubular member through the bore of the shotgun.

A method utilizing the shotgun cleaning shell of the present invention may comprise, loading a shotgun cleaning shell in a shotgun in the same way a traditional shell is loaded into a shotgun, wherein the shotgun cleaning shell contains a bead attached to a cord which is attached to contents of the shotgun cleaning shell, firing the shotgun, wherein the bead attached to the cord is propelled through a bore of the shotgun, utilizing the bead attached to the cord to compel the contents of the shotgun cleaning shell through the bore of the shotgun, wherein the contents are compelled at a slow and steady rate.

The foregoing and other features and advantages of the invention will be apparent to those of ordinary skill in the art from the following more particular description of the invention and the accompanying drawing.

BRIEF DESCRIPTION OF THE DRAWINGS

The invention will hereinafter be described in conjunction with the appended drawings where like designations denote like elements, and.

DESCRIPTION OF THE INVENTION

As discussed above, embodiments of the present invention relate to a disposable shotgun cleaning shell device. Generally, a shotgun cleaning shell device configured according to an embodiment of the present invention consists of a shotgun shell case which contains at least one cleaning member such as a solvent cleaning wad connected by a cord to a bead. When a propellant device propels the bead out of a bore of a shotgun, the at least one cleaning member may then be pulled by the cord through the bore of the shotgun.

Figure 1:
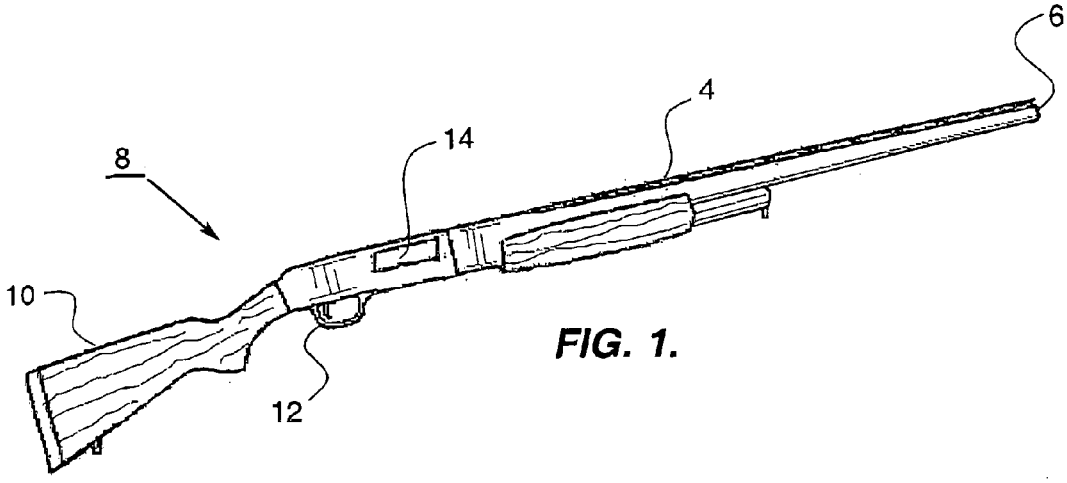
FIG. 1 is a side view of a shotgun configured according to a standard configuration.

FIG. 1 depicts a standard configuration of a shotgun 8. A standard shotgun 8 consists of a stock 10 which is the part of the shotgun 8 that a user grasps to support the shotgun 8 while in use. A trigger 12 is used to fire a shotgun 8 shell. A blast from a shell and shot travel down the inside of the shotgun's 8 barrel 4 along a bore 6. A spent shell is ejected from an ejection port 14 typically located in a side of the shotgun 8.

Figure 2:
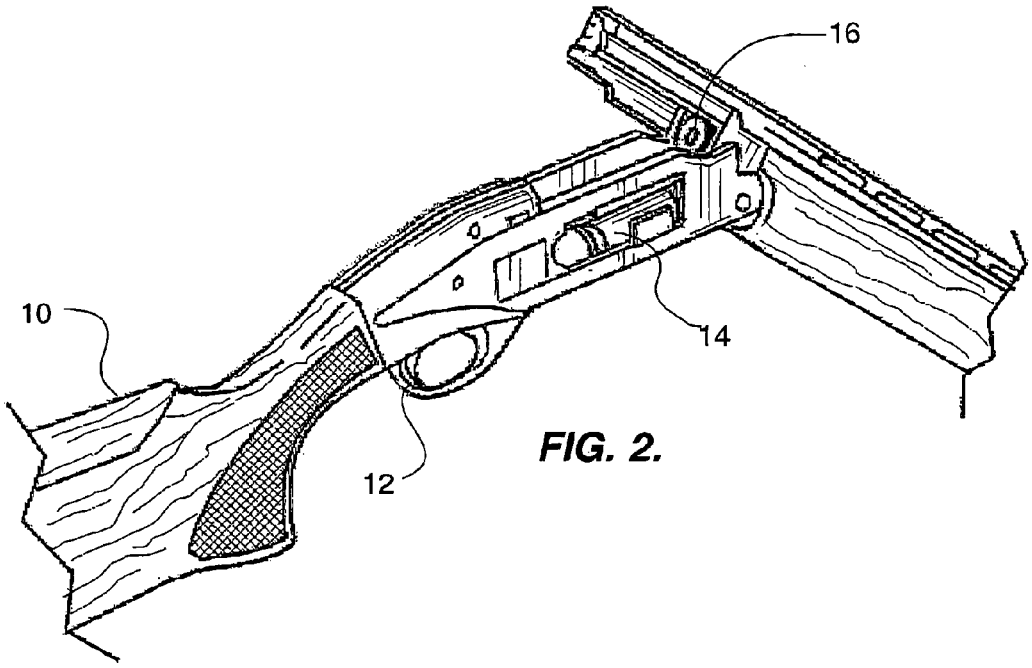
FIG. 2 is a side view of an open shotgun containing a shell configured according to a standard configuration.

FIG. 2 depicts a standard configuration of a shotgun in an open position, which depicts a shotgun cleaning shell 16 located in position to be fired in the shotgun.

Figure 4:
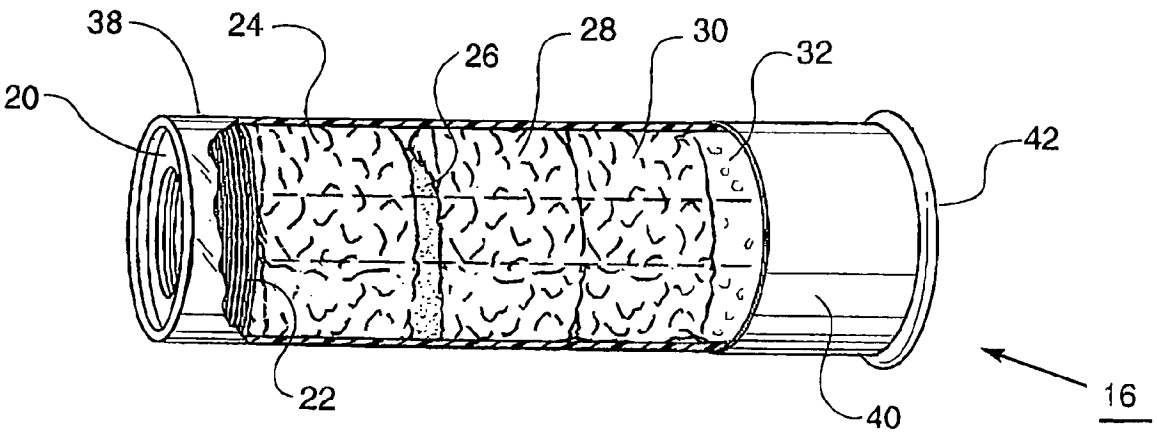
FIG. 4 is a cut away side view of a shotgun cleaning shell configured according to an embodiment of the present invention.

FIG. 4 illustrates a shotgun cleaning shell 16 configured according to an embodiment of the present invention. A shotgun cleaning shell 16 allows a user to clean the bore of a shotgun by simply firing the shotgun with the shell 16 in the gun.

In the present invention, the shotgun cleaning shell 16 comprises a case 38 which contains at least one cleaning member. The case 38 should be formed in the shape of a standard shotgun shell in order to assure that the shotgun cleaning shell 16 will function correctly when the shotgun is fired. Typically, the case 38 will be a hollow cylinder with open ends. The case 38 may be formed from any material which can withstand the energy to be applied to it. The case 38 may simply be a typical shotgun cartridge. It may also be desirable to form the case 38 from a transparent material, in order to allow the user to see what is contained within the case 38 so that the shell 16 is not mistaken for ammunition.

One end of the case 38 is attached to a head 40. The head 40 may be formed from high brass or low brass, which are the standards in the shotgun shell industry. The head 40 may also be formed from any other metallic or non-metallic material which can perform its function while withstanding the blast from shooting the shell 16. Because the shell 16 in this invention requires very little energy, it is even possible to from the head 40 from a plastic material. The head 40 closes one end of the case 38 while providing an opening for a propellant device 42. The head 40 is exposed to a majority of the energy from firing the shell 16.

The opposite end of the case 38 is closed by a seal 20 which is a round disc-like member that is inserted into the case 38. Traditional shotgun shell cartridges are "crimped" closed or folded in leaving their length at approximately 2". However, the cartridge length prior to "crimping" is approximately 2¾ of an inch, which is the maximum length that almost all shotguns will facilitate. The extra ¾ of an inch may be utilized in this invention in order to provide more room to fit the at least one cleaning member in the shell. The seal 20 is used to close the end of the case 38 and the edges of the case are "rolled-over" in order to connect the case 38 and the seal 20. This sealing method only uses approximately ⅛" of the total length of the cartridge.

The seal 20 may be formed from the same material as the case 38 or it may be formed from any material that is strong enough to contain the shell 16 while not in use, however, is weak enough to break when the shell 16 is fired. It may also be desirable to form the seal 20 from transparent material in order to allow the user to view the contents of the case 38.

Figure 3:
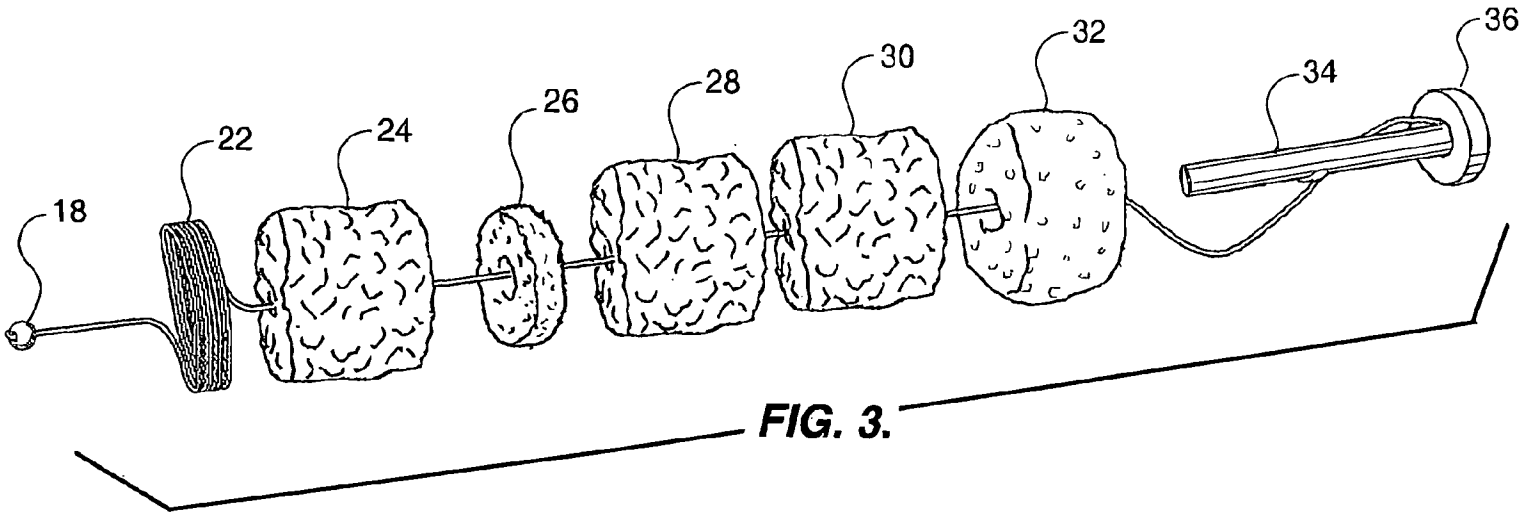
FIG. 3 is a side view of the contents of a shotgun cleaning shell configured according to an embodiment of the present invention.

The case 38 of the shell 16 contains at least one cleaning member which operates to clean the bore when the shell 16 is fired. FIG. 3 illustrates the contents of the shell 16 case 38 and how they are connected in one embodiment of the present invention.

The contents of the shell are connected by a cord 22. One end of this cord 22 is connected to a bead 18. The bead 18 is propelled through the seal when the shell is fired. The bead 18 is preferably a glass or hematite bead with a hole thru the middle to allow the cord 22 to be attached to the bead 18. The cord 22 may be attached to the bead 18 by threading the cord 22 through the bead 18 and tying at least one knot. The cord 22 may be further secured by gluing it to the bead 18 with a compound such as super glue. The bead 18 may be formed from any material which can withstand the heat from firing the shell and the impact of breaking the seal. The bead 18 is preferably formed from glass, hematite or ceramics. Some plastics may also be used to form the bead 18, however, these tend to be cost prohibitive. Additionally, the shell contains chemical solvents that could react to softer plastics. The bead 18 may be of any size or shape that can be propelled through the seal.

The bead 18 is connected to the cord 22. The cord 22 may be formed from any material that can withstand the heat from the shell being fired 18, while having enough strength to allow the user to pull the contents of the shell through the bore of the shotgun. The cord 22 may be formed from several types and tensile strengths of cord woven together in order to form a cord 22 with the preferred characteristics. Preferred materials may include combinations of cotton and nylon blends. These combinations tend to create cord 22 with the appropriate heat resistance and tensile strength. If a cord 22 is used that is not heat resistant, the initial blast of the shell being fired will compromise the strength and the unit will fail. Additionally, it may be desirable to coat the cord 22 with gun oil to further protect the integrity.

In embodiments of the present invention, a solvent cleaning wad 24 is attached to the cord 22 adjacent to the bead 18. The solvent cleaning wad 24 may be formed from any material which will absorb and hold bore cleaning solvent. Possible embodiments of the solvent cleaning wad 24 may include raw cotton that is permeated with bore cleaning solvent. Raw cotton is used because of the additional scrubbing effect of the crushed cotton seeds still in the cotton. Other materials may be used though raw cotton was found to be effective because of cost, availability, absorption and strength.

The size of the solvent cleaning wad 24 is important because if the solvent cleaning wad 24 is not big enough, not enough pressure will be exerted onto the inside diameter of the bore. Each gauge of shotgun requires the correct sizing of the cleaning unit in its entirety. Therefore, if the solvent cleaning wad 24 is too small, it will not be cleaning effectively. If the solvent cleaning wad 24 is too big, it will not release from the case and may cause the cord 22 to break because the resistance will be too great. The most effective size of the solvent cleaning wad 24 to work properly inside the case, releasing from the case and cleaning effectively is 30% larger than the outside perimeter of the case 38, plus or minus 10%.

An effective embodiment of a solvent cleaning wad 24 design is made up of 4 to 5 strands of raw cotton approximately ¼" (for typical 12 gauge cleaning unit). These strands are held together by a thread mesh made of light weight cotton. This threaded mesh holds the raw cotton together and helps to prevent cotton fibers from escaping the solvent cleaning wad 24 and becoming residue in the bore. These multi-strand lengths of raw cotton are then cut at approximately 1.3" lengths and connected such as with a surgeons slip knot.

The solvent cleaning wad 24 may be secured to a tubular member 34 and the cord 22 with a surgeons knot which tightens around the solvent cleaning wad 24 as it is pulled from the shell. The knot is slightly loose when manufactured. This slightly loose knot allows the solvent cleaning wad 24 to be pulled out of the case, releasing from the tube 34, the knot then tightens as the solvent cleaning wad 24 is pulled through the bore of the shotgun. Additionally, the knot tightens over the solvent cleaning wad 24 causing the cotton strands in the solvent cleaning wad 24 to expand and become a super absorbent collector of residue. This squeezing action, also, causes the cleaning solvents to be pushed out to the edges of the solvent cleaning wad 24 maximizing the amount of solvents applied to the bore of the shotgun.

A bore scrubber pad 26 is connected to the cord 22 adjacent the solvent cleaning wad 24. Ideally, the bore scrubber pad 26 is connected to the cord 22 approximately 2 inches from the solvent cleaning wad 24. This unit may be made of any dense, strong, hard material that scrubs the bore and removes glazing, plastic and gun powder residue from the bore by using significant pressure and rough edged strands of the bore scrubber pad to scrape away residue already partly dissolved by the previous solvent cleaning wad 24. One possible material for forming the bore scrubber pad 26 is dense, strong and very hard carbon laced polymers.

The bore scrubber pad 26 may be approximately 25% larger in diameter than the outside perimeter of the case 38. Because the bore scrubber pad 26 may be made with dense particles of cross-linking polymers it has space between the strands and compresses well into the shotgun case. However it expands to its original size when pulled from the case with the cord 22. The bore scrubber pad 26 is preferably ¼" thick. This allows for larger cleaning surface inside the bore while allowing it to be compressed in the case.

A dry wad 28 is attached to the cord 22 adjacent the bore scrubber pad 26. The dry wad 28 may be formed from raw cotton with a surgeons knot as the solvent cleaning wad 24 is. The dry wad 28 is dry and collects particles and solvent from the bore. It is also directly behind the bore scrubber pad 26, which pushes on the bore scrubber pad 26 forcing it to be flat against the bore thereby maximizing its scrubbing surface. By being directly behind the bore scrubber pad 26, the dry wad 28 collects the solvent and residue lifted by the solvent and the bore scrubber pad 26.

A gun oil wad 30 is attached to the cord 22 adjacent the dry wad 28. The gun oil wad 30 may be formed from raw cotton with surgeons knots just as the solvent cleaning wad 24 is. The gun oil wad 30 is also laced with gun oil that protects and preserves the metal in the bore of the shotgun. The gun oil wad 30 is ideally approximately 2 inches away from the dry cotton wad 28. Just as in the solvent cleaning wad 24, the multi-strand design forces the gun oil to the edges of the gun oil wad 30 so it can be applied to the bore.

Adjacent the gun oil wad 30 a collector swab 32 is attached to the cord 22. The collector swab 32 may be formed from any material that collects the remaining residue and smoothes the oil film on the bore. An embodiment of a collector swab 32 is made of high density resilient and chemical resistant foam polymer. It is 200% larger than the outside perimeter of the case 38. The collector swab 32 is approximately 2 inches from the gun oil wad along the cord 22. The collector swab 32 smoothes out the oil film throughout the circumference of the bore and with the immense pressure of the oversized pad, the oil is forced out through thousands of capillaries in the pad.

The end of the cord 22 opposite the bead 18 is attached to a squeegee 36. The squeegee 36 evenly distributes the gun oil on the metal and forces excess oil onto the collector swab 32. The squeegee 36 may be made of dense synthetic rubber and is approximately 2% larger than the outside perimeter of the case 38.

A tubular member 34 is attached to the squeegee 36. The cord 22 does not travel through the tubular member 34 however the cord 22 is attached to the tubular member 34 at the approximate location of the connection between the tubular member 34 and the squeegee 36. The bead 18 is congruent to the tubular member 34 at the end opposite the squeegee 36. The solvent swab 24, bore scrubber pad 26, dry swab 28, gun oil swab 30, and collector swab 32 are all packed into the case surrounding the tubular member 34 with the bead 18 sitting on the tubular member above all of the swabs. The tubular member 34 also contains the blast from a propellant device 42 as illustrated in FIG. 4.

The propellant device 42 may be a standard shotgun primer, springs, compressed air or any other device which could be used to propel the bead 18 and the cord 22 through the bore of the shotgun. The propellant device 42 is inserted into the head 40, enters through the squeegee 36, as illustrated in FIG. 3, and then into the tubular member 34.

When the shell is fired the propellant device 42 sends a blast or a force through the tubular member 34, as shown in FIG. 3. The blast travels through the tubular member 34 forcing the bead 18 and the attached cord 22 through the bore of the shotgun, which prevents the at least one cleaning member from being effected by any gun powder residue from the propellant device 42. The user then slowly pulls the cord 22 through the bore pulling the attached swabs through the bore followed by the squeegee 36.

In using the shell, the user places the shell in the shotgun just as they would put a regular shell in the shotgun. The user then fires the shotgun cleaning shell which fires the propellant device forcing the bead through the seal and out the bore. The user then slowly pulls the cord attached to the bead compelling the various cleaning swabs through the bore followed by the squeegee which is the final stage in the cleaning process. A pulling aid such as a small bamboo stick may be included with the shotgun cleaning shell which allows the user to wrap the cord around the pulling aid allowing the user to pull on the cord more easily. The tubular member is attached to the squeegee and cord, and therefore is also pulled through the bore.

In other embodiments of the present invention, different combinations and variations of cleaning members may be attached to the cord. For instance, the dry swab may be replaced with a second solvent cleaning swab or the dry swab may even be left off completely. It is also possible that the tubular member may have bristles and may act as a brush to scrub the bore as the tubular member is removed from the bore. Any variation of cleaning members desirable may be connected to the cord provided it can all be packed into the shell case.

Alternate embodiments of the present invention may be designed for the different gauges of different shotguns. The sizes and shapes of the cleaning members and the location of these members on the cord may be altered in order to optimize the cleaning ability in smaller or larger shotgun bores. Therefore, dimensions given in this specification are only exemplary and are not meant to be limiting.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention. For example, the components may be formed of rubbers (synthetic and/or natural), glasses, composites such as fiberglass, carbon-fiber and/or other like materials, polymers such as plastic, polycarbonate, PVC plastic, ABS plastic, polystyrene, polypropylene, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. A Shotgun Cleaning Shell for cleaning the bore of a shotgun, wherein the shell comprises:

a cylindrical shell case;

a head connected to an end of the case;

a seal connected to an end of the case opposite the head;

a bead contained within the case;

a cord wherein an end of the cord is connected to the bead;

at least one cleaning member connected to the cord;

a squeegee connected to an end of the cord opposite the end connected to the bead;

a tubular member wherein an end of the tubular member is connected to the squeegee and the cord is outside of the tubular member and wherein the bead is contiguous the end of the tubular member opposite the end of the tubular member connected to the squeegee;

a propellant device attached to the head and within the tubular member;

wherein, the propellant device propels the bead through a bore of a shotgun, the bead exiting the bore; and wherein a user can draw the at least one cleaning member and the squeegee through the bore of the shotgun.

2. The shell of claim 1, wherein at least one of the at least one cleaning members is a solvent cleaning wad.

3. The shell of claim 1, wherein at least one of the at least one cleaning members is a bore scrubber pad.

4. The shell of claim 1, wherein at least one of the at least one cleaning members is a gun oil wad or a dry wad.

5. The shell of claim 1, wherein at least one of the at least one cleaning members is a collector wad.

6. The shell of claim 1, wherein the propellant device further comprises a shotgun shell primer.

7. The shell of claim 1, wherein the propellant device further comprises a spring.

8. A Shotgun Cleaning Shell for cleaning the bore of a shotgun, wherein the shell comprises:

a cylindrical shell case;

a head connected to an end of the case;

a seal connected to an end of the case opposite the head;

a bead contained within the case;

a cord wherein an end of the cord is connected to the bead;

a solvent cleaning wad connected to the cord adjacent to the bead;

a bore scrubber pad connected to the cord adjacent the solvent cleaning wad;

a dry wad connected to the cord adjacent the bore scrubber pad;

a gun oil wad connected to the cord adjacent the dry wad;

a collector wad connected to the cord adjacent the gun oil wad;

a squeegee connected to the cord adjacent the collector wad and at an opposite end of the cord from the bead;

a tubular member, wherein the squeegee is connected to an end of the tubular member, wherein the cord is outside the tubular member and the bead is contiguous an end of the tubular member opposite the end connected to the squeegee;

wherein the solvent cleaning wad, bore scrubber pad, dry wad, gun oil wad, and collector wad encircle the tubular member;

a propellant device connected to the head and within the tubular member;

wherein the propellant device propels the bead through a bore of a shotgun; and wherein a user uses the cord to draw the solvent cleaning wad, bore scrubber pad, dry wad, gun oil wad, collector wad, squeegee and tubular member through the bore of the shotgun.

9. The shell of claim 8, wherein the propellant device comprises a shotgun shell primer.

10. The shell of claim 8, wherein the propellant device comprises a spring.

11. The shell of claim 8, wherein the bore scrubber pad is attached to the cord approximately two inches from the solvent cleaning wad.

12. The shell of claim 8, wherein the dry wad is attached to the cord approximately two inches from the bore scrubber pad.

13. The shell of claim 8, wherein the gun oil wad is attached to the cord approximately two inches from the dry wad.

14. The shell of claim 8, wherein the collector wad is attached to the cord approximately two inches from the gun oil wad.

15. The shell of claim 8, wherein the squeegee is approximately 2% to 5% larger than the outside perimeter of the case.

* * * * *